US010844872B2

(12) United States Patent
Godo et al.

(10) Patent No.: US 10,844,872 B2
(45) Date of Patent: Nov. 24, 2020

(54) BLOWER

(71) Applicant: SHINANO KENSHI KABUSHIKI KAISHA, Nagano (JP)

(72) Inventors: Shin-ichiro Godo, Nagano (JP); Akishige Umematsu, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 0 days.

(21) Appl. No.: 16/176,878

(22) Filed: Oct. 31, 2018

(65) Prior Publication Data

US 2019/0154056 A1 May 23, 2019

(30) Foreign Application Priority Data

Nov. 22, 2017 (JP) ..... 2017-224674

(51) Int. Cl.
*F04D 29/42* (2006.01)
*F04D 17/10* (2006.01)
(Continued)

(52) U.S. Cl.
CPC ..... *F04D 29/4213* (2013.01); *F04D 17/10* (2013.01); *F04D 29/281* (2013.01);
(Continued)

(58) Field of Classification Search
CPC ..... F04D 29/28; F04D 29/281; F04D 29/284; F04D 29/4213; F04D 29/4226;
(Continued)

(56) References Cited

U.S. PATENT DOCUMENTS

2007/0201976 A1* 8/2007 Higashida ..... F04D 29/162 415/206
2009/0094979 A1* 4/2009 Eissler ..... F01D 3/00 60/602
(Continued)

FOREIGN PATENT DOCUMENTS

JP 2006-152972 6/2006
JP 2013-79625 5/2013
(Continued)

OTHER PUBLICATIONS

Extended European Search Report dated Apr. 8, 2019 in corresponding European Patent Application No. 18200352.5.
(Continued)

*Primary Examiner* — Nathaniel E Wiehe
*Assistant Examiner* — Ryan C Clark
(74) *Attorney, Agent, or Firm* — Stephen J. Weyer, Esq.; Stites & Harbison, PLLC

(57) ABSTRACT

There is provided a blower capable of maintaining output performance and adjusting a thrust acting in an axial direction of an impeller while reducing the number of parts. A flow path is formed in an intake port provided in a central part in the axial direction of the first housing and a blowing passage connecting the intake port and the discharge port as top surface portions of a housing-side shroud connecting to the intake port and an impeller-side shroud formed in the impeller which face the blowing passage are adjacent to each other in the radial direction.

7 Claims, 7 Drawing Sheets

(51) Int. Cl.
*F04D 29/28* (2006.01)
*F04D 29/44* (2006.01)

(52) U.S. Cl.
CPC ..... *F04D 29/4206* (2013.01); *F04D 29/4226* (2013.01); *F04D 29/441* (2013.01)

(58) Field of Classification Search
CPC .. F04D 29/0473; F04D 17/10; F05B 2260/15; F05B 2260/304; F01D 3/00; F01D 3/02
See application file for complete search history.

(56) References Cited

U.S. PATENT DOCUMENTS

| | | | | |
|---|---|---|---|---|
| 2013/0236303 | A1* | 9/2013 | Teramoto | F04D 17/08 415/206 |
| 2017/0030206 | A1* | 2/2017 | Kim | F01D 11/02 |
| 2017/0122339 | A1* | 5/2017 | Sun | F04D 25/024 |
| 2018/0003183 | A1* | 1/2018 | Dybenko | F04D 25/0613 |
| 2019/0290081 | A1* | 9/2019 | Yoshino | F04D 29/42 |

FOREIGN PATENT DOCUMENTS

| | | |
|---|---|---|
| JP | 2016098660 | 5/2016 |
| WO | WO-2017/179498 | 10/2017 |

OTHER PUBLICATIONS

Office Action dated Feb. 20, 2020 in corresponding Japanese Patent Application No. 2017-224674.

* cited by examiner

FIG.4A
| | DIMENSION [mm] | | | ROTATION SPEED [r / min] | | |
|---|---|---|---|---|---|---|
| | | | | 20000 | 40000 | 60000 |
| | DH | DL | DO | THRUST FORCE [N] | THRUST FORCE [N] | THRUST FORCE [N] |
| No.1 | 32.0 | 30.6 | 46.0 | -0.030 | -0.034 | -0.088 |
| No.2 | 34.0 | 32.6 | 46.0 | 0.014 | 0.194 | 0.471 |
| No.3 | 30.0 | 28.6 | 46.0 | -0.073 | -0.263 | -0.695 |
| No.4 | 32.0 | 30.6 | 42.0 | 0.020 | 0.130 | 0.298 |
FIG.4B
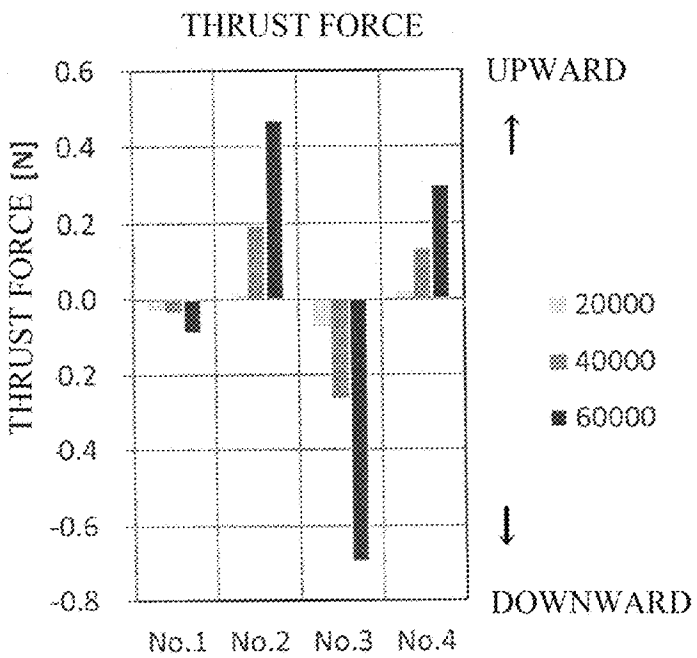
FIG.4C
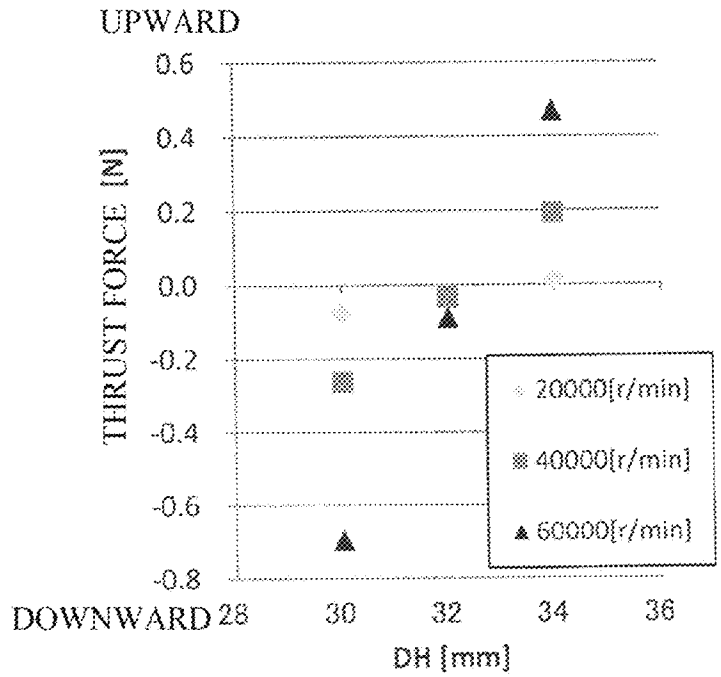

53
M
51
54
53
52
M
Y
2c
8a
3e
3a
2
3e
2c
10
M
Y
UPWARD
DOWNWARD
S2
S1
S2
S1
S2
S1
MAGNITUDE OF THRUST FORCE
DOWNWARD THRUST FORCE
UPWARD THRUST FORCE

BLOWER

CROSS-REFERENCE TO RELATED APPLICATION

This application is based upon and claims the benefit of priority of the prior Japanese Patent Application No. 2017-224674, filed on Nov. 22, 2017, and the entire contents of which are incorporated herein by reference.

TECHNICAL FIELD

The present invention relates to a blower used for, for example, medical equipment, industrial equipment, consumer equipment and so on.

BACKGROUND ART

In the blower conventionally used, reduction in size is required on one hand, and a high pressure, a high flow rate and high responsiveness are required on the other hand due to improvement of required performance. Accordingly, the technique is aiming to reduce the diameter of an impeller and to rotate the impeller at higher speed. However, the requirements such as the high pressure and the high flow rate may cause increase in thrust load due to size increase of a motor and increase in thrust of the impeller, which leads to reduction of the lifetime of a bearing.

Specifically, the motor requires a high output when the blower is reduced in size, therefore, it is difficult to reduce the side as a blower motor. That is, even when a impeller 53 is reduced in size in FIG. 5A, a diameter of a motor M is increased, therefore, it is difficult to reduce the entire size of a blower in a radial direction (see PTL 1: JP-A-2016-98660).

SUMMARY OF INVENTION

Technical Problem

In response to the above, a blowing passage 51 is arranged at a position apart from the motor M in an axial direction (close to a top housing 52) as shown in FIG. 5B for reducing the size of the blower, which can reduce a diameter of a blower regardless of the motor diameter. This has also an advantage that a thrust acting in the axial direction of the impeller 53 can be reduced.

However, blower performance is drastically reduced unless a shroud 54 that separates the impeller 53 and the blowing passage 51 through which compressed air is blown is installed. Moreover, the number of parts is increased as the shroud 54 is installed as a separate part, which increases man-hours for assembly and management.

Solution to Problem

In response to the above issue, one or more aspects of the present invention are directed to provide a blower capable of maintaining output performance and adjusting the thrust acting in the axial direction of the impeller while reducing the number of parts.

The disclosure concerning some embodiments described below has at least the following structures.

In a blower in which an impeller and a rotor are respectively assembled to a rotor shaft rotatably supported inside a case body having a first housing that houses the impeller and a second housing that houses a motor and outside air is sucked from an axial direction into the case body by rotation of the impeller and discharged from a discharge port provided on an outer side in a radial direction, a flow path is formed in an intake port provided in a central part in the axial direction of the first housing and a blowing passage connecting the intake port and the discharge port as a housing-side shroud connecting to the intake port and an impeller-side shroud formed in the impeller are adjacent to each other in the radial direction.

In the intake port provided in the central part in the axial direction of the first housing and the blowing passage connecting the intake port and the discharge port, the flow path is formed as the housing-side shroud connecting to the intake port and the impeller-side shroud formed in the impeller are adjacent to each other in the radial direction. The impeller and part of the shroud are integrally formed, therefore, it is not necessary to provide the shroud forming the blowing passage for guiding outside air sucked from the intake port of the first housing to the discharge port as a separate part, as a result, output performance can be maintained while reducing the number of parts in the blower.

It is preferable that the impeller-side shroud is integrally molded in a ring shape so as to connect end portions on an outer peripheral side of a plurality of blades formed to stand on a disc-shaped main plate, which is arranged to face the second housing.

Accordingly, in a case where the impeller is resin-molded, the impeller-side shroud can be integrally molded with the blades on the outer peripheral side of the disc-shaped main plate, therefore, not only the number of parts can be reduced but also mass productivity and assemblability can be improved. Moreover, the impeller-side shroud and the main plate are formed in the ring shape so as to connect the end portions on the outer peripheral side of the blades, which leads to improvement in strength of the impeller-side shroud.

It is preferable that an upper surface of the main plate is arranged to be adjacent to a bottom surface of the second housing in the radial direction.

Accordingly, for example, the upper surface of the main plate and the bottom surface of the second housing form a continuous surface, not a stepped surface, thereby improving the flow of air.

It is preferable that an outer end portion in the radial direction of the impeller-side shroud is formed to protrude by a predetermined amount from an outer peripheral end portion of the main plate to the outer side in the radial direction.

Accordingly, air sucked from the intake port by rotation of the impeller passes between the housing-side shroud and the main plate and is sent to the blowing passage through between the impeller-side shroud and the second housing. At this time, the protruding amount in the outer end portion in the radial direction of the impeller-side shroud is adjusted, thereby suitably controlling a thrust acting in the axial direction of the impeller and extending the lifetime of the bearing.

It is preferable that top surface portions of the housing-side shroud and the impeller-side shroud which face the flow path are formed to be a continuous surface or that the top surface portion of the housing-side shroud is arranged at a position lower than an opposite surface portion of the top surface portion of the impeller-side shroud.

Accordingly, it is possible to eliminate a danger that the airflow sucked from the intake port flows back between the blade and the top surface portion of the housing-side shroud to disturb the airflow and reduce the efficiency.

It is preferable that a thrust force acting on the impeller is adjusted by a dividing position in the radial direction where the housing-side shroud and the impeller-side shroud are adjacent to each other. Accordingly, the thrust in thrust directions acting on the impeller (upward or downward force) can be suitably adjusted and the lifetime of the bearing can be extended by changing the dividing position in the radial direction where the housing-side shroud and the impeller-side shroud are adjacent to each other.

Advantageous Effects of Invention

According to the blower, it is possible to maintain output performance while reducing the number of parts and to improve the durability of the bearing by adjusting the thrust acting in the axial direction of the impeller.

BRIEF DESCRIPTION OF DRAWINGS

FIGS. 4A to 4E are a table view, graph views, a plan view and a cross-sectional view in the axial direction of the impeller showing the relationship between dividing positions in the radial direction of a housing-side shroud and an impeller-side shroud and thrust forces acting on the impeller.

DESCRIPTION OF EMBODIMENTS

Hereinafter, a blower according to an embodiment of the present invention will be explained with reference to the attached drawings. First, an outline structure of the blower will be explained with reference to FIGS. 1A to 1E, FIGS. 2A and 2B, and FIGS. 3A and 3B.

Figure 2A:
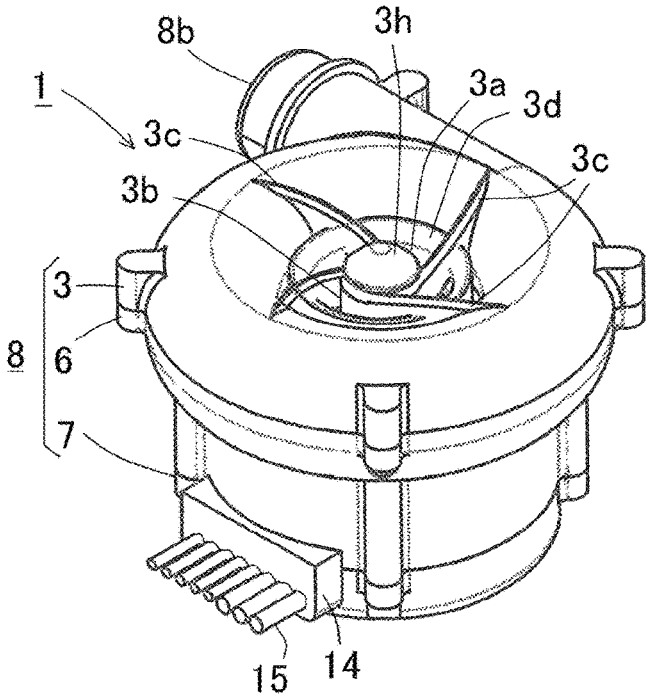
FIGS. 2A and 2B are a perspective view of the blower of FIGS. 1A to 1E and a cross-sectional view taken along an arrow X-X of FIG. 1A.
Figure 2B:
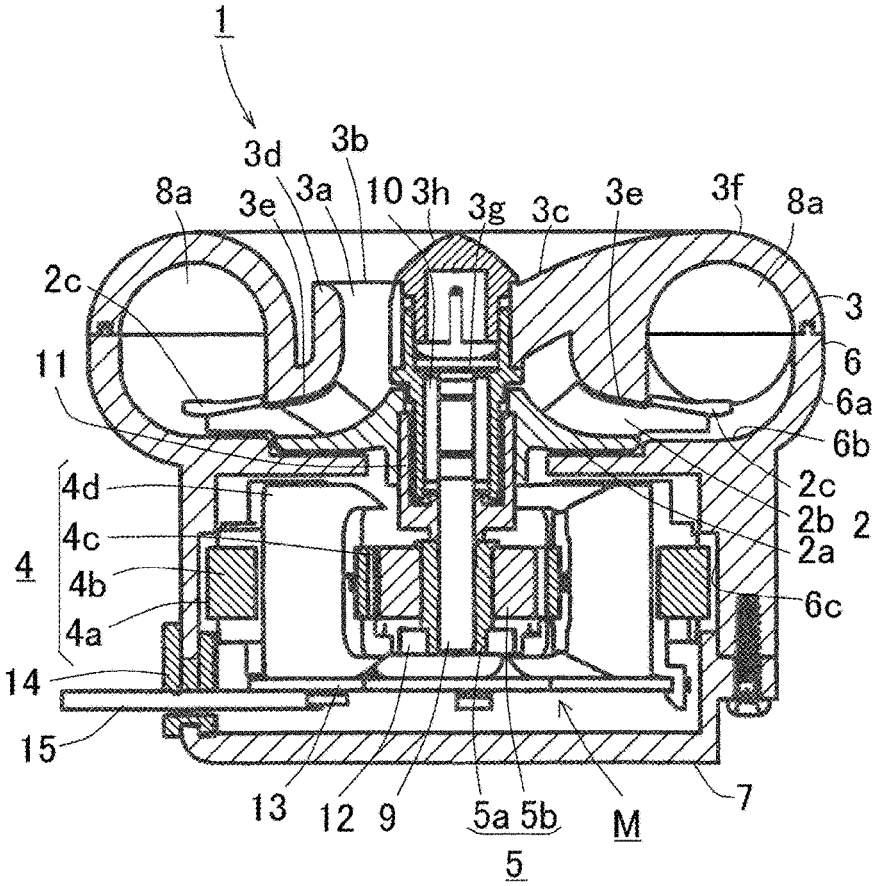

A blower 1 has the following structure. As shown in FIGS. 2A and 2B, a top housing (first housing) 3 housing an impeller 2 and a bottom housing (second housing) 6 housing a stator 4 and a rotor 5 (a motor M) are integrally fixed by screws and a bracket 7 is integrally assembled to a bottom part of the bottom housing 6 to form a case body 8. The impeller 2 and the rotor 5 are respectively assembled to a rotor shaft 9 rotatably supported inside the case body 8.

As shown in FIG. 2B, a tubular bearing holding portion 3*b* is integrally formed with an intake port 3*a* by a plurality of connecting beams 3*c* which are radially formed. A housing-side shroud 3*e* is formed continuously from a tubular opening wall 3*d* that forms the intake port 3*a*. The housing-side shroud 3*e* is arranged so as to correspond to the impeller 2, forming a blowing passage toward an outer side in a radial direction. A top-side curved portions 3*f* is continuously formed from the housing-side shroud 3*e*. In the bottom housing 6 facing the top-side curved portion 3*f*, a bottom-side curved portion 6*a* is provided. A blowing passage 8*a* circling around an outer periphery of the impeller 2 is formed by combination of the top-side curbed portion 3*f* and the bottom-side curved portion 6*a* (see FIG. 2A and FIGS. 1A to 1C). Compressed air blowing through the blowing passage 8*a* formed in the case body 8 is discharged from a discharge port 8*b* (see FIGS. 1D and 1E).

As shown in FIG. 2B, a bearing 10 rotatably supporting one end side of the rotor shaft 9 is assembled inside the bearing holding portion 3*b*. As the bearing 10, a sliding bearing formed in a tubular shape (for example, a fluid dynamic pressure bearing or the like) is preferably used. One end of the rotor shaft 9 is rotatably supported by the bearing 10 and a shaft end is supported so as to abut on an end cover 3*g* provided at a stepped part inside the bearing holding portion 3*b*. An upper end of the bearing holding portion 3*b* is closed by a top cover 3*h*. In this case, the size can be easily reduced as compared with a case of using a rolling bearing, which can reduce noise and vibration. Moreover, the bearing 10 does not generate heat due to mechanical loss even when a small-sized motor is rotated at high speed, therefore, the air volume can be secured without reducing durability.

The impeller 2 is coaxially assembled to an outer periphery of the bearing holding portion 3*b*. A bearing housing 11 is integrally assembled to the rotor shaft 9 by press fitting, adhesion and so on. The impeller 2 is integrally assembled to the bearing housing 11 by molding, adhesion, press fitting and so on. In the impeller 2, blades 2*b* are formed to stand at plural places on a disc-shaped main plate 2*a* from a central part toward outer peripheral directions (see FIG. 3A). An impeller-side shroud 2*c* is integrally molded in a ring shape on the outer peripheral side of the blades 2*b* (see FIGS. 3A and 3B). The impeller-side shroud 2*c* is formed so as to connect upper end portions on the outer peripheral side of the blades 2*b*, which is formed to face a bottom portion 6*b* of the bottom housing 6.

The rotor 5 is assembled to the other end side of the rotor shaft 9. Specifically, a rotor magnet 5*b* is concentrically attached to the rotor shaft 9 through a rotor yoke 5*a*. N-poles and S-poles are alternately magnetized in the rotor magnet 5*b* in a circumferential direction. The rotor 5 is assembled so as not to come off in the axial direction by the rotor yoke 5*a* and a balance correction portion 12 assembled to the end portion of the rotor shaft 9 (see FIG. 3B). A sensor magnet is attached to the balance correction portion 12 according to a structure of a motor drive circuit.

In FIG. 2B, the motor M is housed in the bottom housing 6. Specifically, the stator 4 is assembled inside the bottom housing 6. A ring-shaped core-back portion 4*b* is fixed and a stator core 4*a* is assembled to an inner wall surface of the bottom housing 6. Pole teeth 4*c* are provided at plural places to protrude from the ring-shaped core-back portion 4*b* to the inner side in the radial direction. Coils 4*d* are wound around respective pole teeth 4*c*. The pole teeth 4*c* of the stator core 4*a* are arranged so as to face the rotor magnet 5*b*. Moreover, a motor substrate 13 is provided in the bottom portion of the bottom housing 6, and coil leads pulled out from respective coils 4*d* are connected thereto.

As shown in FIG. 2B, a grommet 14 is attached to an opening formed between end surfaces of the bottom housing 6 and the bracket 7. Lead wires 15 are taken out to the outside through the grommet 14 so that power is fed (see FIGS. 1B, 1C and 1E).

As shown in FIG. 2B, when the motor M is activated, the blower 1 sucks outside air into the tubular opening wall 3*d* from the axial direction of the intake port 3*a* of the top housing 3 by rotation of the impeller 2, and compressed air is sent from the inner side to the outer side in the radial direction between the main plate 2*a* and the housing-side shroud 3*e* along the blades 2*b* by the rotation of the impeller 2 and passes between the impellers-side shroud 2*c* formed in the ring shape and the bottom portion 6*b* of the bottom housing 6 to be fed into the blowing passage 8*a*. Then, the compressed air circulates around the blowing passage 8*a* and discharged from the discharge port 8*b* of the case body 8 (see FIGS. 1A to 1E). The impeller-side shroud 2*c* and the housing-side shroud 3*e* are connected to form the shroud. The main plate 2*a* of the impeller 2 is arranged on the bottom portion 6*b* of the bottom housing 6. It is desirable that an upper surface of the main plate 2*a* is arranged adjacent to a bottom surface of the bottom housing 6 so as to form a continuous surface. Accordingly, the upper surface of the main plate 2*a* and the bottom surface of the bottom housing 6 make the continuous surface, not a stepped surface, therefore, the flow of air is improved. An outer edge of the impeller-side shroud 2*c* and an outer edge of the main plate 2*a* are connected by integral molding, which can improve strength of the impeller-side shroud 2*c*.

Though it is desirable that the upper surface of the main plate 2*a* and the bottom surface of the bottom housing 6 make the continuous surface, not the stepped surface, a structure with the stepped surface may be considered depending on the structure of products. In that case, the upper surface of the main plate 2*a* is desirably positioned higher than the bottom surface of the bottom housing 6. According to the structure, the stepped portion does not interfere with the flow of air, which improves the flow of air.

Figure 1A:
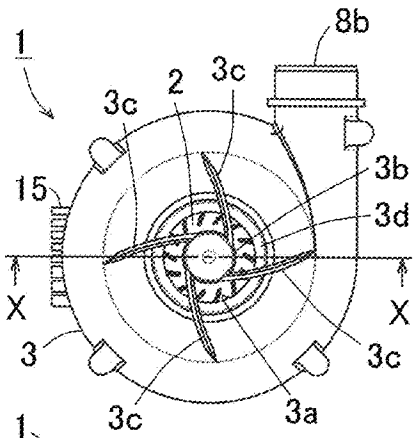
FIGS. 1A to 1E are a plan view in an axial direction, a front view, a bottom view, a right side view and a rear view of a blower.
Figure 1B:
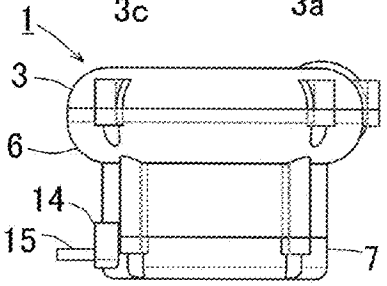
Figure 1C:
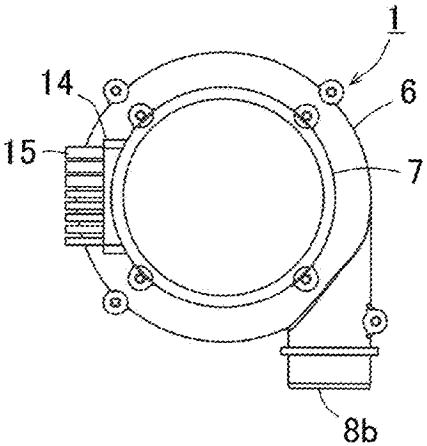
Figure 1D:
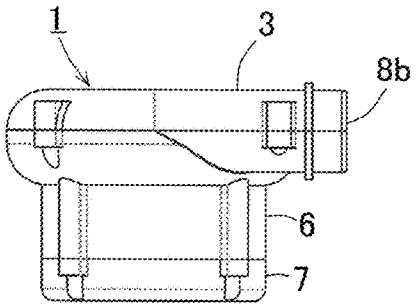
Figure 1E:
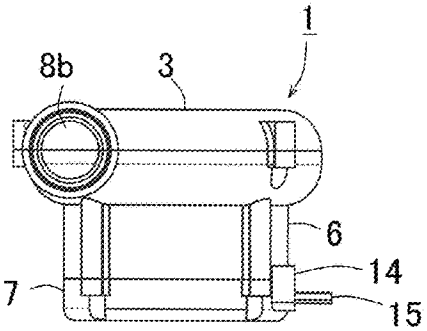

As shown in FIG. 1A, the bearing holding portion 3*b* is integrally formed with the intake port 3*a* of the top housing 3, and the bearing 10 rotatably supporting the rotor shaft 9 is assembled inside the bearing holding portion 3*b*, therefore, the impeller 2 can be coaxially assembled to the outer periphery of the bearing holding portion 3*b*. Accordingly, a length of the rotor shaft 9 can be short as shown in FIG. 2B, and a dimension in the axial direction of the blower 1 can be reduced. The center of rotation comes close to the bearing 10 as the bearing 10 rotatably supporting the rotor shaft 9 is arranged as close as possible to the impeller 2, therefore, imbalance of the impeller 2 hardly has an influence as a load, and rotation balance is improved.

Furthermore, air is sucked in the axial direction from the intake port 3*a* of the top housing 3 when the motor M is activated and the impeller 2 is rotated, therefore, heat generation of the bearing 10 due to mechanical loss is cooled by the intake. As a result, temperature increase in the bearing 10 is suppressed, which contributes to suppression of oil deterioration, therefore, durability can be improved. The bearing 10 is assembled to the bearing holding portion 3*b* provided in the intake port 3*a*, however, the arrangement of the bearing 10 is not limited to this, and for example, the bearing 10 may also be arranged apart from the impeller 2 in the axial direction.

Figure 3A:
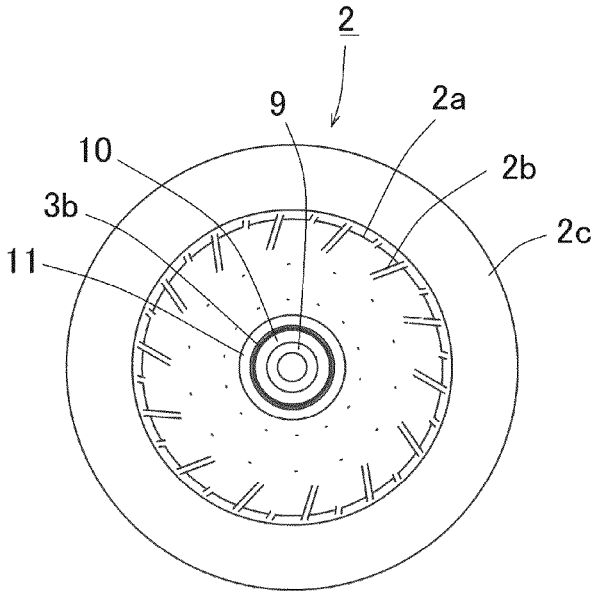
FIGS. 3A and 3B are a front view and a plan view of an impeller and a rotor assembled to a rotor shaft.
Figure 3B:
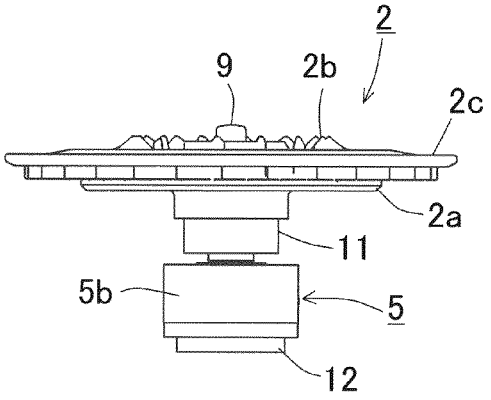

As shown in FIG. 3B, the rotor 5 is assembled to the other end side of the rotor shaft 9. Specifically, the rotor magnet 5*b* is attached to the rotor shaft 9 through the rotor yoke 5*a* so as not to come off by the balance correction portion 12 provided at the shaft end portion. The rotor magnet 5*b* is arranged to face the pole teeth 4*c* of the stator core 4*a* held in the bottom housing 6. Accordingly, the bearing on the motor M's side is omitted and the shaft length of the rotor shaft 9 is shortened as well as the rotation center is brought close to the bearing 10, as a result, rotation balance is achieved easily.

Top surface portions 3*e*1 and 2*c*1 where the housing-side shroud 3*e* from the intake port 3*a* of the top housing 3 and the impeller-side shroud 2*c* from the housing-side shroud 3*e* face the blowing passage (see FIG. 6A) are adjacent to each other in the radial direction to form a flow path. As part of the shroud (impeller-side shroud 2*c*) is integrally formed with the impeller 2 as described above, it is not necessary to provide a shroud separating the intake port 3*a* and the blowing passage 8*a* in the top housing 3 as a separate part, therefore, output performance can be maintained while reducing the number of parts of the blower 1.

The impeller-side shroud 2*c* is integrally molded in a ring shape so as to connect outer peripheral end portions of the blades 2 in the ring shape apart from the main plate 2*a*. For example, an outer edge portion of the main plate 2*a* is preferably arranged at a mold separation position which can be integrally molded with the impeller-side shroud 2*c*. Accordingly, when the impeller is resin-molded, the impeller-side shroud 2*c* can be integrally molded with the main plate 2*a* and the blades 2*b* on the outer peripheral side, which can not only reduce the number of parts but also improve mass productivity and assemblability.

Moreover, an outer edge portion in the radial direction of the impeller-side shroud 2*c* is formed so as to protrude by a predetermined amount from the outer peripheral edge portion of the main plate 2*a* to the outer side in the radial direction.

Accordingly, the thrust acting on the axial direction of the impeller 2 can be suitably controlled and the lifetime of the bearing can be extended by adjusting the protruding amount of the outer edge portion in the radial direction of the impeller-side shroud 2*c* as described later. This point will be explained with reference to an experimental example.

FIGS. 4A, 4B, 4C, 4D and 4E are a table view, graph views, a plan view and a cross-sectional view in the axial direction of the impeller showing the relationship between dividing positions in the radial direction of the housing-side shroud 3*e* and the impeller-side shroud 2*c* and thrust forces acting on the impeller 2.

FIG. 4A shows results obtained by simulating the difference in thrust force due to the difference in shapes of the impeller 2, particularly in the dividing positions in the radial direction between the housing-side shroud 3*e* and the impeller-side shroud 2*c* (shroud cutting positions).

Figure 4D:
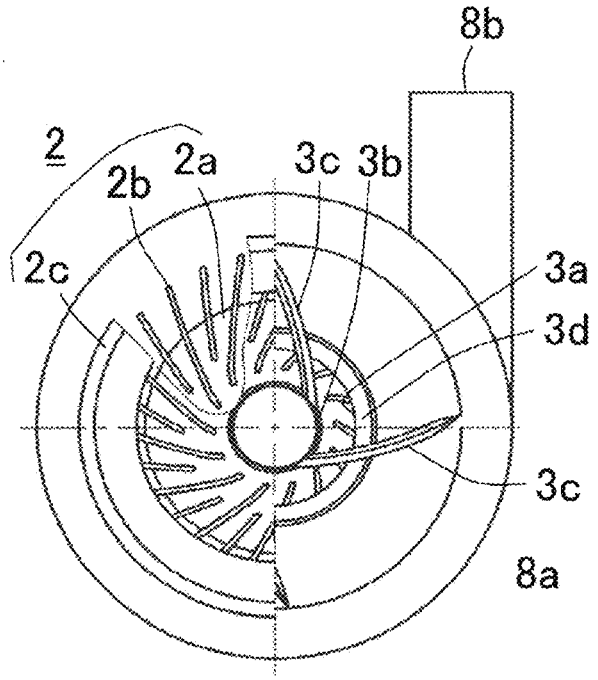
Figure 4E:
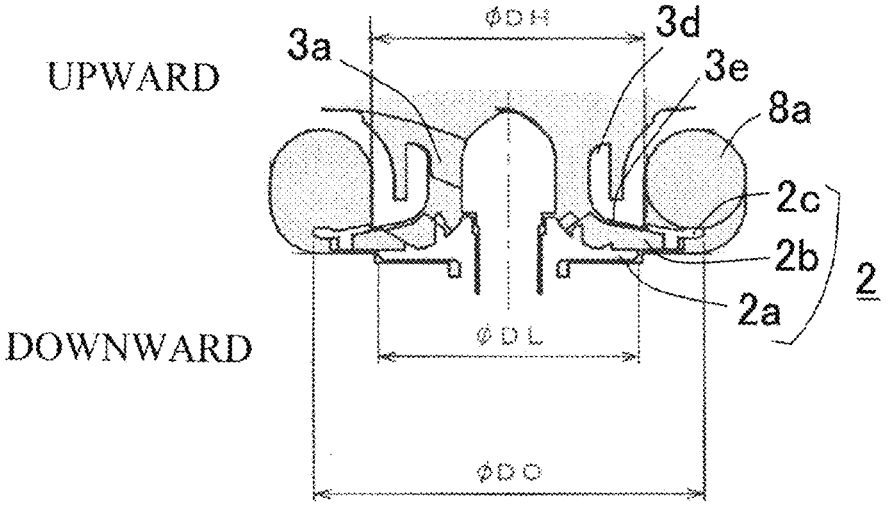

In FIG. 4A, a dimension DH indicates an outer diameter of the housing-side shroud 3*e*, a dimension DL indicates an outer diameter of the main plate 2*a* of the impeller 2 and a dimension DO indicates an outer diameter of the impeller-side shroud 2*c*, respectively (see FIGS. 4D and 4E). Thrust forces N were measured by setting a flow rate of fluid to 0.10 $m^3$/min and by changing the rotational speed at 20000 rpm, 40000 rpm and 60000 rpm respectively.

On the basis of a sample of No. 1, No. 2 indicates a sample obtained by moving a cutting position of the housing-side shroud to the outer side in the radial direction by 1 mm, No. 3 indicates a sample obtained by moving the cutting position of the housing-side shroud to the inner side in the radial direction by 1 mm and No. 4 indicates a sample obtained by reducing the outer diameter dimension DO (impeller outer diameter) of the impeller-side shroud 2*c* to the inner side in the radial direction just by 2 mm.

Thrust forces of respective samples are shown in the graph view of FIG. 4B. In the sample of No. 1, it is found that a downward thrust force is increased as the rotation speed is increased. The sample of No. 2 is obtained by moving the shroud cutting position to the outer side in the radial direction by 1 mm from the position of No. 1, in which it is found that an upward thrust force is increased as the rotation speed is increased. The sample of No. 3 is obtained by moving the cutting position of the housing-side shroud to the inner side in the radial direction by 1 mm from the position of No. 1, in which the downward thrust force is increased as the rotation speed is increased.

As described above, it is found that the thrust force drastically differs according to the difference of the dividing position (shroud cutting position) in the radial direction of the housing-side shroud 3*e* and the impeller-side shroud 2*c* from the comparison of the samples No. 1 to No. 3.

It is also found that the thrust force largely differs according to the difference of the outer diameter dimension DO (impeller diameter) of the impeller-side shroud 2*c* from comparison between the sample of No. 1 and the sample of No. 4.

Furthermore, the graph view of FIG. 4C shows variations of the thrust force in accordance with the dimension of the outer diameter DH of the housing-side shroud 3*e* (shroud cutting position) and the rotation speed.

It is found that the downward thrust force to the impeller 2 is increased with the increase of the rotation speed when DH is 30 mm. When DH is increased to 32 mm, the thrust force acting on the impeller 2 is close to zero and hardly changed even when the rotation speed is increased. When the size of DH is increased to 34 mm, the upward thrust force to the impeller 2 is increased with the increase of the rotation speed.

Accordingly, it is found that the thrust force acting on the impeller 2 can be suitably adjusted by adjusting the shroud dividing position.

Figures 5A, 5B, 5C:
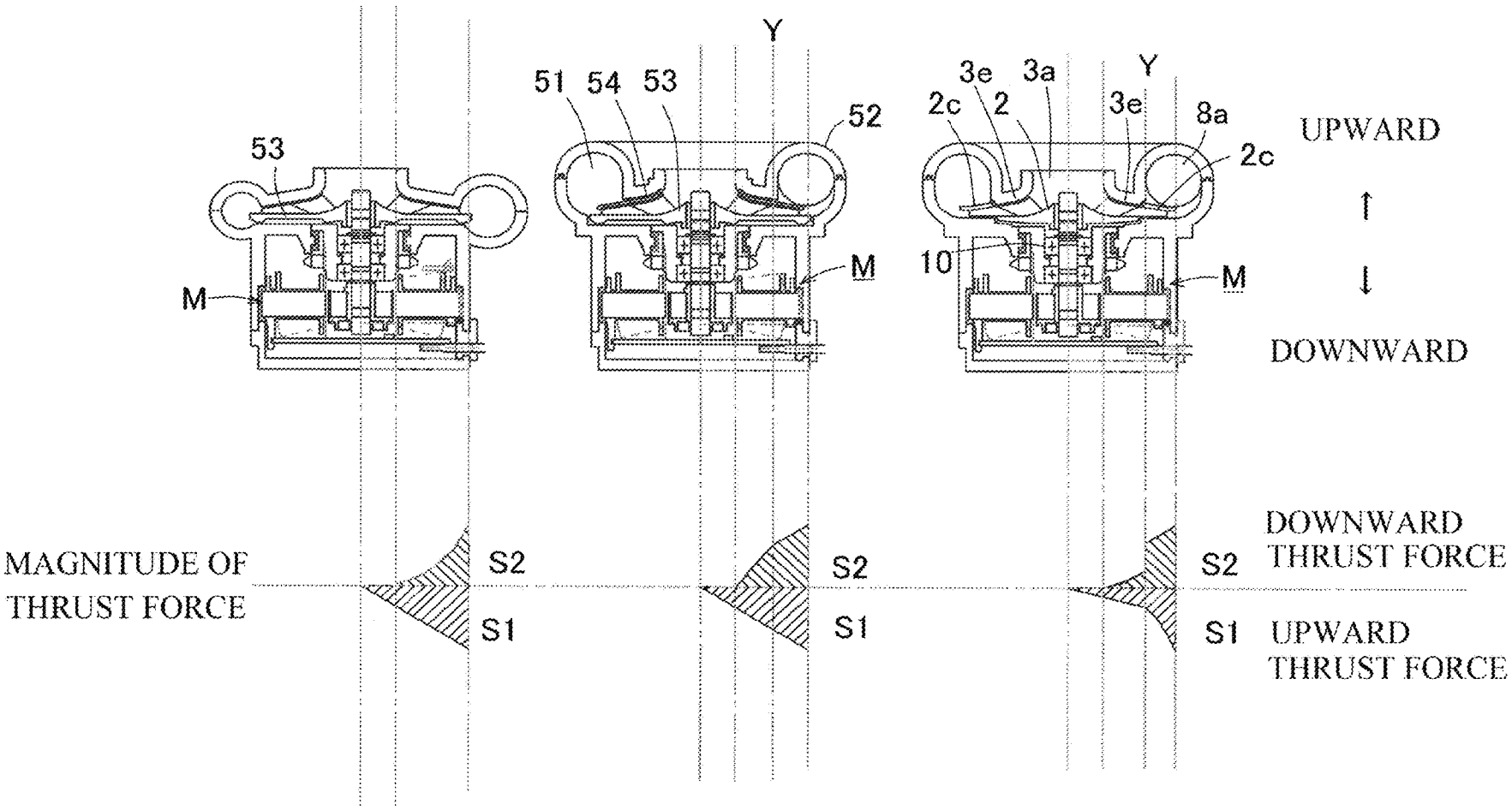
FIGS. 5A to 5C are comparison explanatory views for magnitudes of thrust forces acting on positions in the radial direction of the impeller according to structures of blowers.

FIGS. 5A to 5C are comparison explanatory views for magnitudes of thrust forces acting on positions in the radial direction of the impeller according to different structures of blowers. FIG. 5A shows a blower provided with the blowing passage in the outer periphery of the impeller, FIG. 5B shows a blower provided with the blowing passage at a position higher than the impeller and provided with the shroud in the top housing 3 as a separate part and FIG. 5C shows a blower provided with the housing-side shroud 3*e* and the impeller-side shroud 2*c* in the divided manner in the radial direction according to the present embodiment. Note that plurally rolling bearings are used as the bearing 10 rotatably supporting the impeller in every embodiment.

Graph views at lower parts of FIG. 5A to 5C show magnitudes of thrust forces at a rotation radius position of the impeller. An area S1 of a hatched portion indicates the magnitude of an upward thrust and an area S2 of a hatched portion indicates the magnitude of a downward thrust.

As the upward thrust force is larger than the downward thrust (S1>S2) in the structure of FIG. 5A, there is a danger that a mechanical loss of the end cover 3*g* is increased and the lifetime is reduced.

In the structure of FIG. 5B, the upward thrust force is much larger than the downward thrust force (S1>S2) from the rotation center to a dividing position Y in the radial direction between the housing-side shroud 3*e* and the impeller-side shroud 2*c*, however, the downward thrust is rapidly increased on the outer side of the dividing position Y in the radial direction but does not exceed the upward thrust (S1<S2).

In contrast to the above, in the structure of FIG. 5C, the upward thrust force exceeds the downward thrust force (S1>S2) from the rotation center to the dividing position Y in the radial direction between the housing-side shroud 3*e* and the impeller-side shroud 2*c*, however, the difference is slight, and the downward thrust force is rapidly increased on the outer side of the dividing position Y in the radial direction and exceeds by far the upward thrust force (S1<S2).

The impeller 2 and part of the shroud (the impeller-side shroud 2*c*) are integrally formed as described above, therefore, it is not necessary to provide the shroud separating the intake port 3*a* and the blowing passage 8*a* in the top housing 3 as a separate part, and output performance can be maintained while reducing the number of parts of the blower 1.

Moreover, the dividing position in the radial direction between the housing-side shroud 3*e* and the impeller-side shroud is adjusted, thereby suitably adjusting the thrust in thrust directions acting on the impeller 2.

Here, variations of arrangement structures between the housing-side shroud 3*e* and the impeller-side shroud 2*c* will be explained with reference to FIGS. 6A to 6D.

Figure 6A:
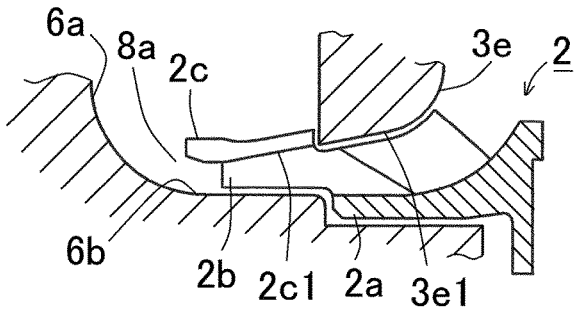
FIGS. 6A to 6D are explanatory views showing variations of arrangement structures of the housing-side shroud and the impeller-side shroud.

FIG. 6A shows a case where the top surface portion 3*e*1 of the housing-side shroud 3*e* which faces the blowing passage and the top surface portion 2*c*1 of the impeller-side shroud 2*c* which faces the blowing passage are arranged so as to form one continuous surface as shown in the above embodiment. In this case, reflux of airflow sucked from the intake port 3*a* (see FIG. 2B) does not occur.

Figure 6B:
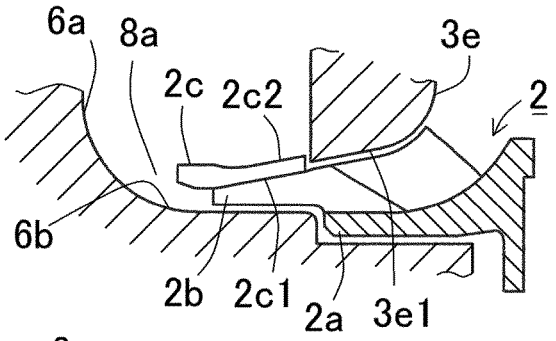

FIG. 6B shows a case where there is a level difference between the top surface portion 3*e*1 of the housing-side shroud 3*e* which faces the blowing passage and the top surface portion 2*c*1 of the impeller-side shroud 2*c* which faces the blowing passage. Specifically, the top surface portion 3*e*1 of the housing-side shroud 3*e* is arranged at a position lower than an upper surface portion 2*c*2 (an opposite surface portion of the top surface portion 2*c*1) of the impeller-side shroud 2*c* but at a position higher than the top surface portion 2*c*1. That is, the top surface portion 3*e*1 of the housing-side shroud 3*e* may be arranged in a range of a plate thickness of the impeller-side shroud 2*c*. Also in this case, reflux of the airflow sucked from the intake port 3*a* (see FIG. 2B) does not occur.

Figure 6C:
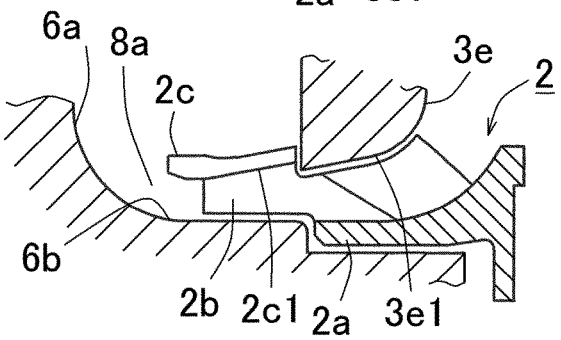

FIG. 6C shows another example in which there is a level difference between the top surface portion 3*e*1 of the housing-side shroud 3*e* which faces the blowing passage and the top surface portion 2*c*1 of the impeller-side shroud 2*c* which faces the blowing passage. Specifically, the top surface portion 3*e*1 of the housing-side shroud 3*e* is arranged at a position lower than the top surface portion 2*c*1 of the impeller-side shroud 2*c*. Also in this case, reflux of the airflow sucked from the intake port 3*a* (see FIG. 2B) does not occur.

Figure 6D:
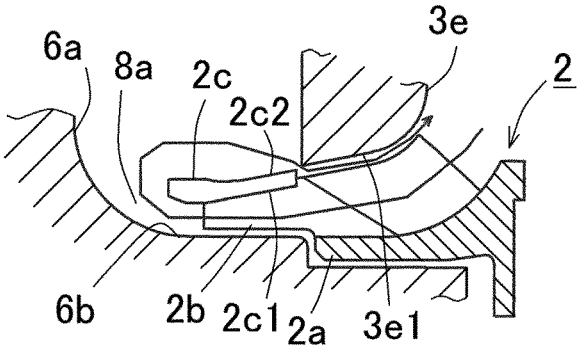

FIG. 6D shows a case where a malfunction occurs because of a level difference generated between the top surface portion 3*e*1 of the housing-side shroud 3*e* which faces the blowing passage and the top surface portion 2*c*1 of the impeller-side shroud 2*c* which faces the blowing passage. Specifically, the top surface portion 3*e*1 of the housing-side shroud 3*e* is arranged at a position higher than the top surface portion 2*c*1 of the impeller-side shroud 2*c* as well as higher than the upper surface portion 2*c*2. In this case, there is a danger that the airflow sucked from the intake port 3*a* (see FIG. 2B) flows back between the blade 2*b* and the top surface portion 3*e*1 of the housing-side shroud 3*e* as shown by an arrow to disturb the airflow and reduce the efficiency.

In this case, a portion for narrowing a facing distance is formed between the housing-side shroud 3*e* and the impeller-side shroud 2*c*, for example, by providing a wall for preventing the reflux on the upper surface portion 2*c*2 and by providing an overlapping part between the housing-side shroud 3*e* and the impeller-side shroud 2*c*, thereby taking countermeasures for preventing the reflux.

According to the above, in the arrangement structures of the housing-side shroud 3*e* and the impeller-side shroud 2*c*, occurrence of level difference between the top surface portions is allowed in addition to the case where the top surface portion 3*e*1 and the top surface portion 2*c*1 facing the blowing passage form one continuous surface. In this case, it is desirable that at least the top surface portion 3*e*1 of the housing-side shroud 3*e* is positioned at a position lower than the top surface portion 2*c*2 of the impeller-side shroud 2*c*. However, any of the cases shown in FIGS. 6A to 6D according to the embodiment can be adopted as countermeasures for preventing the reflux can be taken.

Though the fluid dynamic pressure bearing is cited as an example of the bearing 10, the present invention is not limited to this. Other sliding bearings such as a sintered oil retaining bearing may be used. Furthermore, other bearings such as the rolling bearing may be used according to use application, not limited to the sliding bearings.

What is claimed is:

1. A blower in which an impeller with blades and a rotor are respectively assembled to a rotor shaft rotatably supported inside a case body having a first housing that houses the impeller and a second housing that houses a motor, and outside air is sucked from an axial direction into the case body by rotation of the impeller and discharged from a discharge port provided on an outer side in a radial direction, wherein a flow path is formed in an intake port provided in a central part in the axial direction of the first housing and a blowing passage connecting the intake port and the discharge port as a housing-side shroud connecting to the intake port and an impeller-side shroud formed in the impeller are adjacent to each other in the radial direction and wherein an edge portion on an outer peripheral side of the impeller-side shroud in the radial direction is protruded in the flow path, which is formed above front end portions of the blades a bottom portion of the second housing, and disposed to face the bottom portion of the second housing by forming a clearance including an axial height of front end portions of the blades.

2. The blower according to claim 1, wherein the impeller-side shroud is integrally molded in a ring shape so as to connect end portions on an outer peripheral side of blades formed to stand on a disc-shaped main plate, which is arranged to face the second housing.

3. The blower according to claim 2, wherein an upper surface of the main plate is arranged to be adjacent to a bottom surface of the second housing in the radial direction.

4. The blower according to claim 2, wherein an outer end portion in the radial direction of the impeller-side shroud is formed to protrude by a predetermined amount from an outer peripheral end portion of the main plate to the outer side in the radial direction.

5. The blower according to claim 1, wherein top surface portions of the housing-side shroud and the impeller-side shroud which face the flow path are formed to be a continuous surface.

6. The blower according to claim 1, wherein a top surface portion of the housing-side shroud is arranged at a position lower than an opposite surface portion of a top surface portion of the impeller-side shroud.

7. The blower according to claim 1, wherein a thrust force acting on the impeller is adjusted by a dividing position in the radial direction where the housing-side shroud and the impeller-side shroud are adjacent to each other.

* * * * *